United States Patent [19]

Yorks

[11] Patent Number: 4,950,094

[45] Date of Patent: Aug. 21, 1990

[54] COSMETIC DISPENSER AND METHOD

[75] Inventor: Charles H. Yorks, Natick, Mass.

[73] Assignee: The Gillette Company, Boston, Mass.

[21] Appl. No.: 385,671

[22] Filed: Jul. 26, 1989

[51] Int. Cl.[5] ..... A45D 40/06

[52] U.S. Cl. ..... 401/75; 401/175; 222/390

[58] Field of Search ..... 401/68, 175, 178, 171, 401/75, 69, 172, 78; 222/390

[56] References Cited

U.S. PATENT DOCUMENTS

| | | | |
|---|---|---|---|
| 2,818,167 | 12/1957 | McKinley | 206/56 |
| 2,840,231 | 6/1958 | Reichenbach | 206/56 |
| 2,876,161 | 3/1959 | Gieschi | 401/68 X |
| 2,980,246 | 4/1961 | Leshin | 401/75 |
| 3,907,441 | 9/1975 | Idec et al. | 401/75 |
| 4,369,158 | 1/1983 | Woodruff | 264/268 |
| 4,521,127 | 6/1985 | Tomboro et al. | 401/68 |
| 4,545,696 | 10/1985 | Carluccio | 401/175 |
| 4,552,161 | 11/1985 | Hill et al. | 132/88.5 |
| 4,621,935 | 11/1986 | Sussman | 401/82 |
| 4,664,547 | 5/1987 | Rosenwinkel | 401/75 |
| 4,700,448 | 10/1987 | Parker | 29/434 |
| 4,702,399 | 10/1987 | Davis | 222/390 |

FOREIGN PATENT DOCUMENTS

| | | | |
|---|---|---|---|
| 557384 | 5/1957 | Belgium | 401/79 |
| 0182655 | 5/1986 | European Pat. Off. . | |
| 0135861 | 10/1988 | European Pat. Off. . | |
| 2807472 | 8/1979 | Fed. Rep. of Germany . | |
| 3118893 | 11/1982 | Fed. Rep. of Germany | 401/68 |
| WO86/06257 | 11/1986 | PCT Int'l Appl. . | |
| 2173176 | 10/1986 | United Kingdom . | |

*Primary Examiner*—Richard J. Johnson

*Attorney, Agent, or Firm*—Owen J. Meegan; Aubrey C. Brine; Scott R. Foster

[57] ABSTRACT

A container for dispensing a cosmetic product such as a deodorant in stick form comprises a one piece tubular body open at the top having a platform disposed therein movably by means of a dial shaft threaded into the platform. A single opening is formed in the bottom wall of the body through which the dial shaft extends and a washer forms the entire seal between the dial and the bottom wall of the body, while sealing means in the form of a contoured cap member which is disposed wholly within the body and a separate seal, or alternately a contoured flexible sealing element closes the top of the body. The container is filled through the top opening with a quantity of molten product while in the upright condition, the molten product passing through a plurality of openings in the platform to rest on the bottom surface of the container. The container is then closed by the sealing means and inverted with the product in the molten state and remains so during solidification of the product.

18 Claims, 4 Drawing Sheets

COSMETIC DISPENSER AND METHOD

BACKGROUND OF THE INVENTION

The present invention relates to cosmetic products in stick form and more particularly to a container and cosmetic product, and the process of producing the combination of container and stick material as a finished product.

Prior art containers of the type to which the present invention relates have taken a plurality of forms and the filling of these containers, whether from the top or bottom of the structure, has provided a plurality of constructions which are in many instances complex and require a number of parts of intricate configuration. The primary object of a container design of this type is generally to produce a cosmetic product in stick form which is appealing to the user from the visual aspect, as well as the utility aspect of the design.

In the manufacture of a deodorant stick, in order to obtain a desirable aesthetic appearance as well as an easier and more efficient applicator requiring fewer strokes, it is preferable that the product be of a non-circular generally oval cross-sectional configuration and that the upper surface of the stick be of convex contour. It is also highly desirable that the stick material be free of unsightly voids and completely fill the container when first put into use.

With the frequent use of a large proportion of volatile materials such as alcohol in the formulation of stick material, the problem of shrinkage in both size and weight before purchase by the consumer becomes of significance. The problem is greatly amplified by the use of an oval or non-circular container for which conventional sealing cannot be provided by the clamping force of screw threads. The product therefore, tends to exhibit an undesirable gap between the walls of the container and the stick containing the material, when shrinkage occurs.

With the use of formulations containing, for example, as high as 75% volatile material, it is therefore necessary that the container provided for the deodorant stick be sealed from both liquid and vapor leakage prior to its usage by the purchaser.

The present invention has as an object to provide a container for dispensing a cosmetic product such as a deodorant in stick form and a process of filling the container to provide a stick product which is aesthetically pleasing in appearance to the user.

A further object of the invention is to provide a container and process of filling the container as set forth above wherein the stick product is sealed against evaporation of volatile materials and subsequent shrinkage prior to use.

Yet another object of the invention is to provide a container and the process of filling the container as set forth above wherein the container is of simple construction and contains a minimum of parts, allowing for a minimal cost in the production of the cosmetic stick product.

SUMMARY OF THE INVENTION

The aforementioned objects and other objectives which will become apparent as the description proceeds are accomplished by providing a container for dispensing a cosmetic product such as a deodorant in stick form which comprises a one piece body member formed of elongated tubular sidewalls open at the top and having a bottom wall section. Dial means in the form of a disc having a threaded shaft extending from one surface thereof is disposed on the outer wall of the bottom wall section and the shaft is disposed within the body member and extends through an opening formed in the bottom wall section. A platform is provided within the body member having outer edges substantially conforming to the tubular sidewalls and the platform has an opening formed at the center thereof for receiving the threaded shaft in threaded engagement therewith. A unitary washer is disposed between the one surface of the disc and the exterior surface of the bottom wall, the opening formed in the bottom wall section being closely dimensioned to receive the shaft, and the washer forming the entire seal between the one disc surface and the bottom wall.

The platform is generally provided with a plurality of openings formed therein of a size which allows the product in molten form to flow through to the bottom wall of the body member.

In a more detailed sense, the container may further include a cap member inserted in the tubular sidewalls which cap member is provided with an internal surface of concave configuration to form the top surface of the cosmetic product.

The container generally includes sealing means which may in one embodiment take the form of a sealing member overlying the upper edges of the tubular sidewalls contoured to cover the top opening of the container. A cover may be provided comprising downwardly projecting walls having a plurality of horizontal ribs formed on its lower inner surface overlying the outer upper surface of the body member tubular sidewalls which have corresponding ribs formed thereon. Additionally, the singular washer may be formed of a closed cell sponge material which has skin surfaces contacting both the one disc surface and the bottom wall.

The process for manufacturing the cosmetic product employing a tubular body having a top opening bottom wall through which the dial shaft extends and, a platform member movable within the tubular body through rotation of the dial shaft, comprises the steps of rotating the shaft to move the platform to a lower most position in spaced relation with the bottom wall of the tubular body and introducing a predetermined quantity of product in molten form through the top opening of the tubular body. Sealing means is applied in sealing engagement with the top opening of the tubular body and the container is inverted while the product remains in the molten condition. The tubular body of the container is then maintained in the inverted position during solidification.

The sealing means may comprise a cap member which is generally inserted entirely within the tubular body of the container and a sealing member may be placed over the top opening at a subsequent step after applying the cap member and prior to inverting the tubular body to the position in which the solidification of the product takes place.

As an alternate sealing means, a dual purpose contoured sealing member is applied to cover the upper edges of the tubular sidewall in sealing engagement and is of a concave configuration to also thereby form the top of the cosmetic product.

DESCRIPTION OF THE DRAWING

The foregoing and other features of the invention will be more particularly described in connection with the preferred embodiment and with reference to the accompanying drawing, wherein.

DESCRIPTION OF THE PREFERRED EMBODIMENTS

Figure 1:
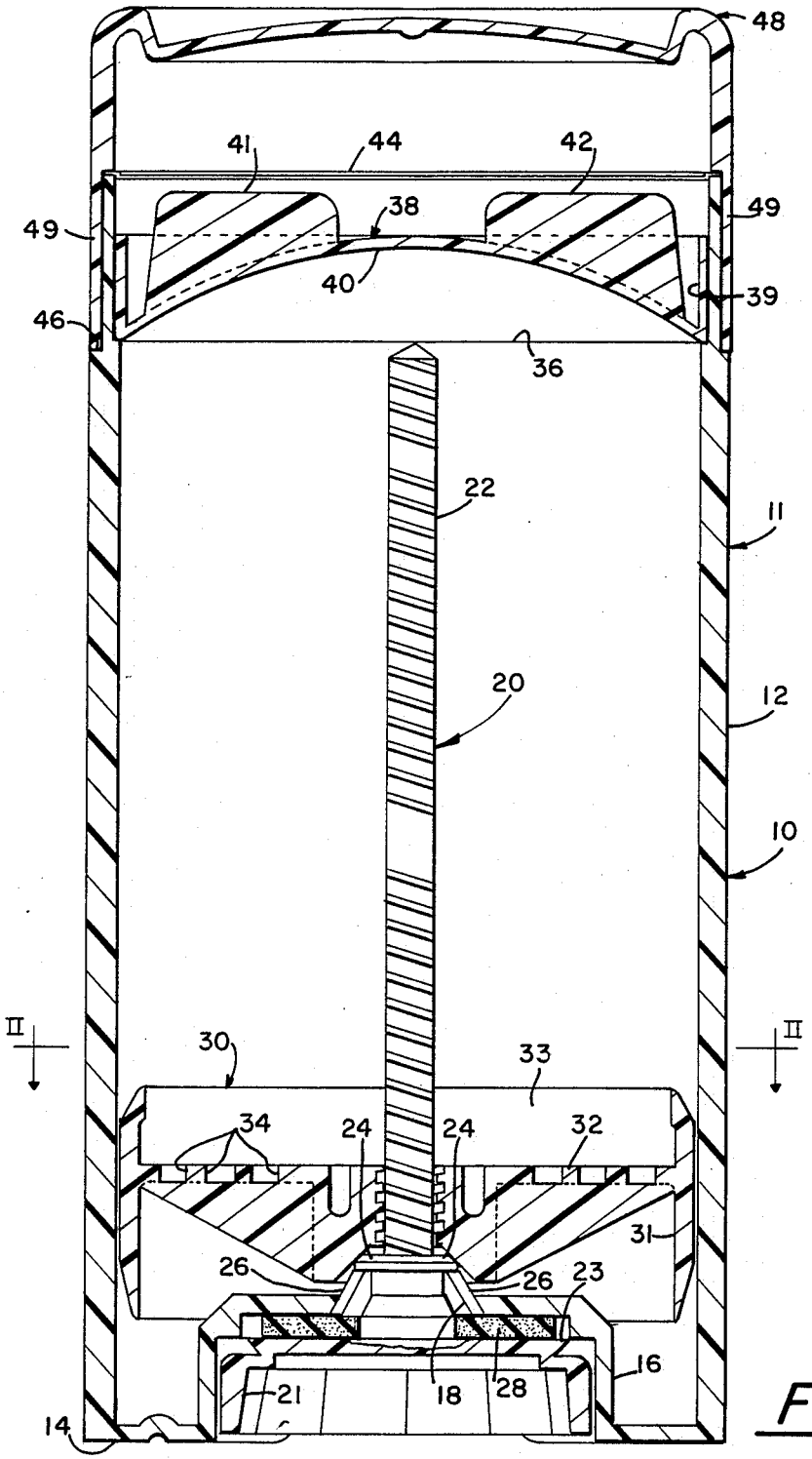
FIG. 1 is a sectional elevational view showing a dispenser or the like embodying the teachings of the present invention.
Figure 2:
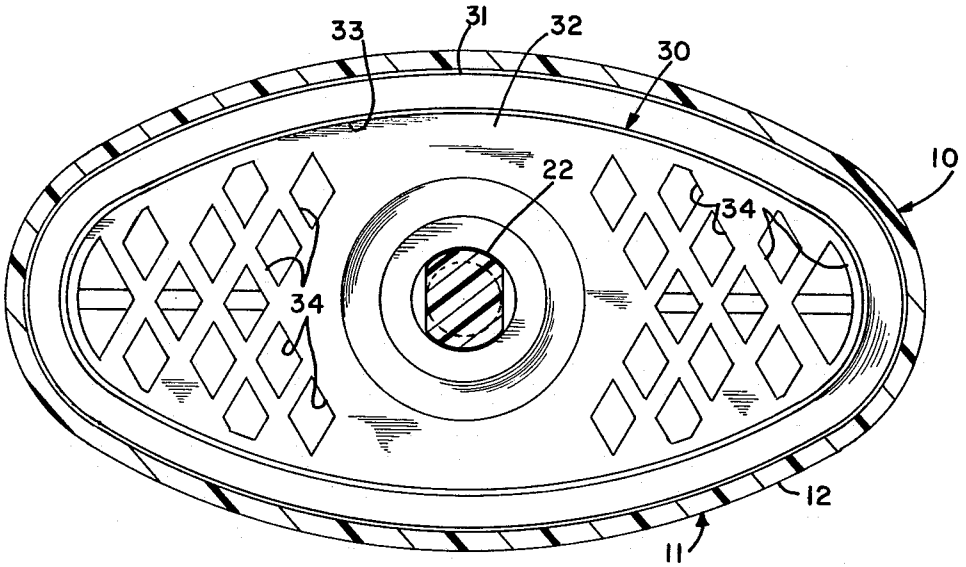
FIG. 2 is a sectional plan view taken along the lines II—II of FIG. 1 showing details of the dispenser of FIG. 1.
Figure 4:
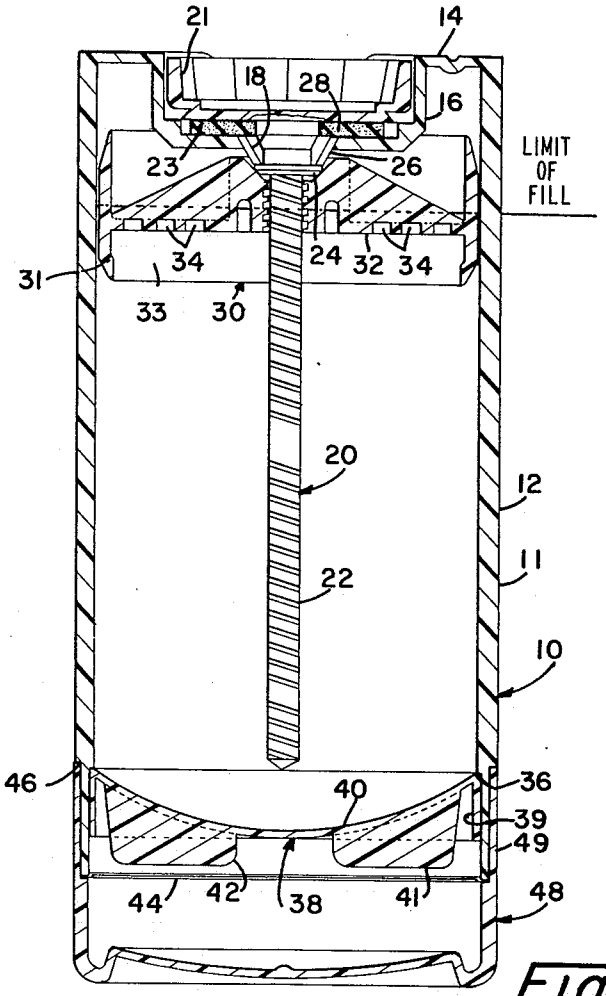
FIG. 4 is a sectional elevational view similar to FIGS. 1 and 3 showing the dispenser of FIGS. 1 through 4 during a subsequent step in the filling process.
Figure 3:
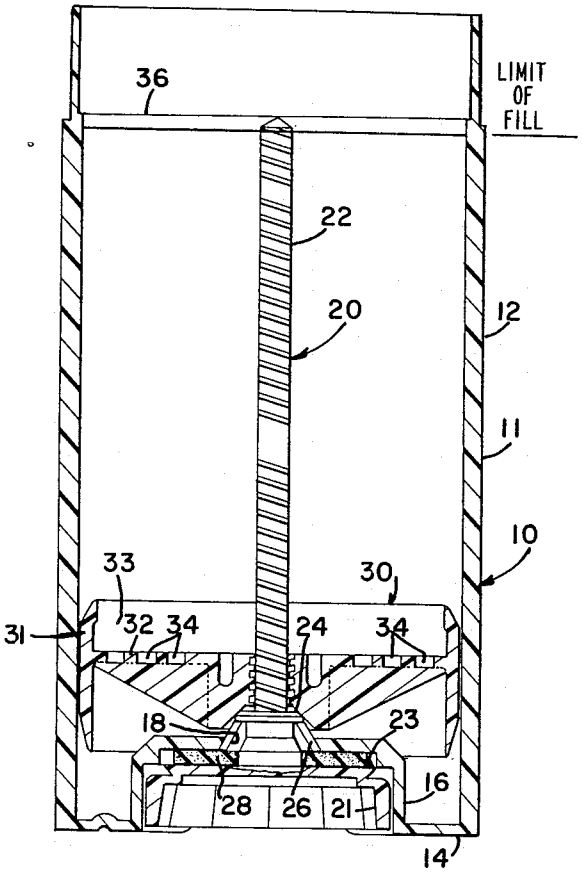
FIG. 3 is a sectional elevational view similar to FIG. 1 showing the dispenser of FIG. 1 during the filling process.

Referring to the drawing and in particular to FIGS. 1, 3 and 4, there is shown one embodiment of a container 10 for dispensing a cosmetic product such as a deodorant in stick form. The container 10 generally comprises a one piece body member 11 formed of elongated tubular sidewalls 12 and a bottom wall section 14. The one piece body member 11 is open at the top, and as best shown in FIG. 2, is substantially oval in cross-section.

The bottom wall section 14 of the body member contains an internally stepped boss 16 of generally circular configuration having a central opening 18 provided therein.

A combined dial-shaft 20 is provided having a dial in the form of a disc 21 located within the external recess formed by the boss 16 and having a threaded shaft 22 extending from one surface 23 of the disc 21 through the opening 18 into the interior of the container 10. The portion of the threaded shaft 22 adjacent the surface 23 is provided with a radially outwardly extending flange 24 and the boss 16 has four spring fingers 26 (two of which are shown in FIGS. 1, 3 and 4) equally spaced about the periphery of the opening 18 and extending inwardly towards the center of the opening. The spring fingers 26 are spaced such that when the threaded shaft 22 is introduced into the container 10, the flange 24 is snapped past the spring fingers and held in interfitting engagement.

Still referring to FIGS. 1, 3 and 4, it will be noted that sealing of the central opening 18 is accomplished by providing a compressible washer 28 having a central opening through which the shaft 22 extends, and which is retained between the surface 23 of the disc 21 and the bottom surface of the boss 16. The washer 28 may be formed of an ethylene propylene diene monomer closed cell sponge material having skin formed on both sides, and is of a thickness dimension wherein the washer is compressed when the flange 24 is snapped beyond the spring fingers 26 with the washer placed between the surface 23 and the bottom surface of the boss 16.

Referring now to FIGS. 1, 3 and 4 taken in conjunction with FIG. 2, the threaded shaft 22 is shown to be threadably engaged with a platform 30 having a peripheral wall 31 for internal engagement with the sidewalls 12 of the container 10 and a substantially horizontal wall 32 extending inwardly from the peripheral wall and forming a cavity 33 with the inner surface of the peripheral wall 31. The threaded engagement between the shaft 22 and the platform 30 provides for movement of the platform in the up and down direction within the container 10. As best shown in FIGS. 1 and 2, the horizontal wall 32 of the platform 30 has a plurality of openings shown here for illustrative purposes to be substantially diamond shaped openings 34 formed therein which are dimensioned of a size to allow the product contained in the container 10 to flow therethrough to the bottom wall section 14 of the container, when the material is in molten form, as will be explained in detail as the description proceeds.

Referring again to FIGS. 1, 3 and 4, the sidewalls 12 of the container 10 are provided with an inwardly projecting shoulder 36 which extends around the inner surface of the sidewalls 12. A cap member 38 having a peripheral wall 39 which is formed to be received in close fitting engagement with that portion of the sidewalls 12 directly above the shoulder 36 extends upwardly from a concave wall 40 and a pair of elongated wings 41 and 42 extend upwardly from the concave wall. It will be noted that the shoulder 36 is spaced from the upper ends of the sidewalls 12 such that the entire cap member 38 including the elongated wings 41 and 42 are inserted entirely within the sidewalls 12 when the cap member 38 is in place. Due to the close fit between the peripheral wall 39 and the sidewalls 12 of the container 10, the wings 41 and 42 are provided as a means to allow the user to grasp the wings and .remove the cap member 38 from the stick product in the container 10.

The sidewalls 12 of the container 10 are provided with a foil seal 44 which is induction sealed to the upper rim of the sidewalls, in a manner which is well known in the art, to effectively seal the container.

Referring to FIG. 1, the top of the container 10 is further provided with an outwardly extending shoulder 46, and a cover 48 having downwardly projecting walls 49 is fit over the top of the container 10 to protect the foil seal 44 from damage during handling, as well as to present a desirable aesthetic appearance to the container 10.

Figure 5:
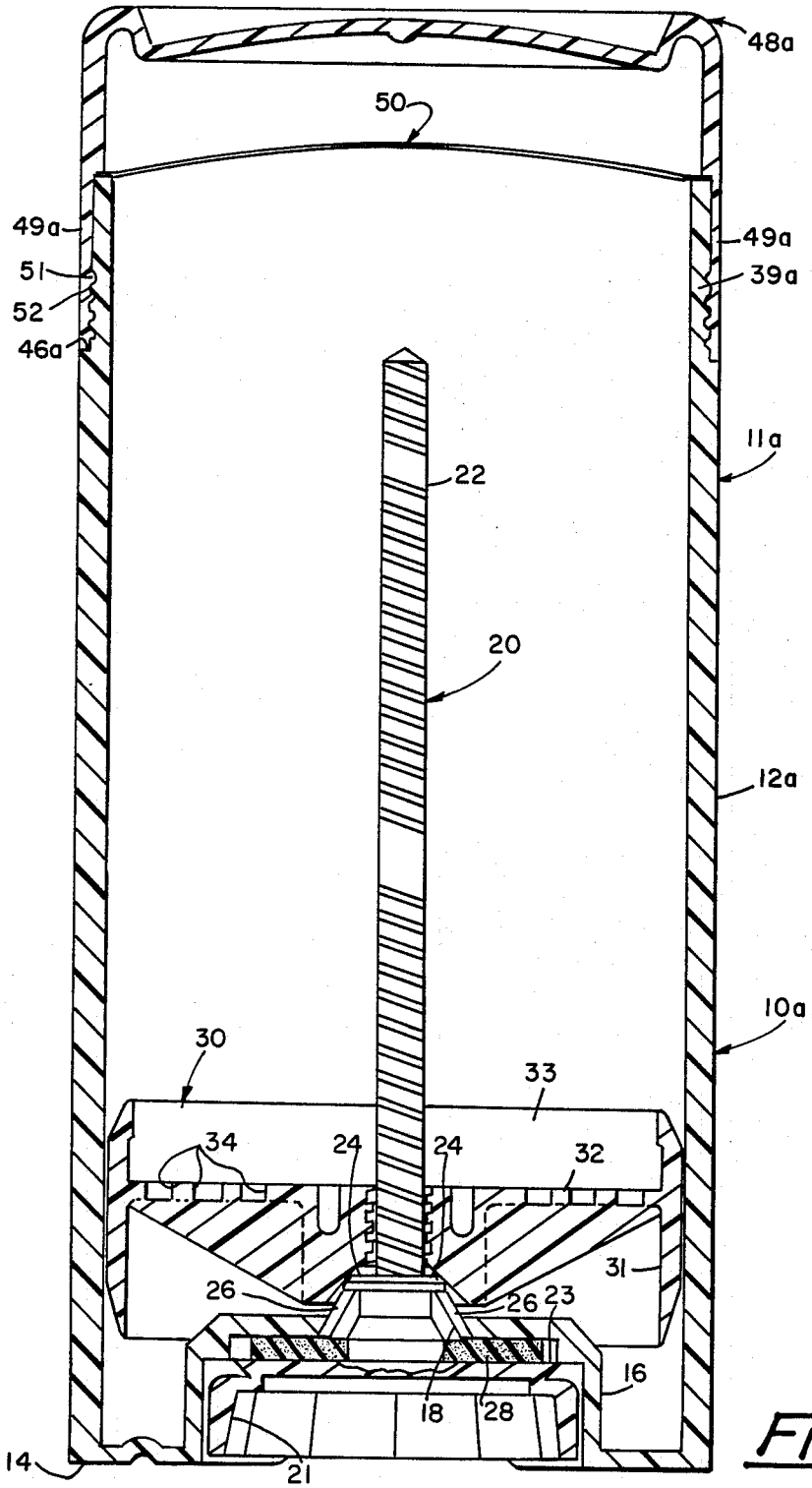
FIG. 5 is a sectional elevational view similar to FIG. 1 showing an alternate embodiment of the structure of FIGS. 1 through 4.

Referring now to FIG. 5, there is shown an alternate embodiment of the invention where like elements have been given like reference numerals as those elements described with reference to FIGS. 1 through 4. A container 10*a* has a body member 11*a* comprising sidewalls 12*a*. It will be noted that the lower portion of the container 10*a* is identical to that depicted in FIGS. 1 through 4, the distinguishing feature of the container being the upper portion of the body member 11*a* which contains peripheral wall 39*a* having a shoulder 46*a*, a contoured sealing member 50 and a cover 48*a* having walls 49*a*, as shown in FIG. 5. It will be noted further that the cap member of FIGS. 1 through 4 has been eliminated from the structure and in its place, the contoured sealing member 50 is provided which performs the dual function of sealing the top opening in the body member 11*a* and providing a concave downwardly facing surface serving to form the upper surface of the stick product manufactured in the container 10. The contoured sealing member 50 may be manufactured of a flexible foil material which is pre-formed in the desired contour and is generally induction-sealed to the upper rim of the sidewalls 12a at the periphery of the top opening.

The embodiment of FIG. 5 further provides a sealing means for the top opening of the body member 11a in the form of a cover 48a having walls 49a terminated in a downwardly directed opening. The internal surface of the walls 49a are provided with a plurality of horizontally disposed ribs 51 in spaced relation with one another and extending inwardly of the cover 48a. The outer surface of the peripheral wall 39a is likewise provided with a plurality of horizontally disposed ribs 52 in spaced relation with one another, which extend outwardly from the peripheral wall 39a.

When the cover 48a is received on the sidewalls 12a of the body member 11a, the mating walls 49a and 39a are so dimensioned that the ribs 51 and 52 are in interfitting engagement and form a positive lock to further seal the internal volume of the body member 11a and the cover 48a. The sealing means between the body member 11a and the cover 48 is not only effective during the manufacture and storage of the product, but also assures a good seal to retard evaporation during subsequent use of the product once the package is opened and the sealing member 50 is removed.

In the process for the manufacture of a cosmetic product, for example a deodorant in stick form, employing the container 10 herein described, the container 10 with the dial shaft 20, the washer 28 and the platform 30 in place are provided and oriented, as best shown in FIG. 3. The deodorant stick to be formed in the container 10 may be of any formulation, however, the present construction lends itself particularly advantageous in those instances where the material constituents include a high percentage of volatile material, for example in the area of 75% of a volatile material such as ethyl alcohol, which could cause severe weight loss problems and shrinkage should evaporation occur prior to the product being put into use. With the container 10 disposed as shown in FIG. 3, with the platform 30 moved down to its lowermost position, a predetermined measured amount of the product in the molten state is introduced into the tubular body member 11 of the container 10. As mentioned above, the openings 34 are of a dimension to allow the product in its molten state to flow to the bottom wall section 14 of the container 10 and the filling proceeds until the product reaches the "limit of fill", a point which is depicted in FIG. 3. With the container 10 disposed in the upright position as shown in FIG. 3, the product in liquid form is prevented from leaking through the bottom of the container by the compressed washer 28 and the relatively small space between the central opening 18 and the portion of the threaded shaft 22 adjacent the surface 23.

As depicted in FIG. 3, the limit of fill may be a point on the container 10 adjacent and slightly below the shoulder 36, but in any circumstance must be below the shoulder 36.

While the product remains in the molten state, the cap member 38 is inserted into the container to rest on the shoulder 36, the foil seal 44 is applied to the top opening of the container 10, and the cover 48 is applied to the assembly. The structure at this point during the process is similar to that shown in FIG. 1, however with the molten material contained within the container 10.

With the product remaining in the molten state, the container 10 is inverted to the position shown in FIG. 4. The still molten material of the product flows back through the openings 34 to rest on the concave wall 40 of the cap member 38 and as will be noted, the predetermined volume of product is such that the material now extends slightly beyond the horizontal wall 32. The close fitting engagement between the peripheral wall 39 of the cap member 38 and the sidewalls 12 of the container 10 is such that the material of the product in molten form does not leak past the cap member 38 and is retained within the bounds of the cap member and the limit of fill, as shown in FIG. 4. The amount of product extending through the openings 34 and slightly beyond is effective to lock the product to the platform and therefore enable the product to be moved both upwardly and downwardly within the container 10 when the product is in use.

The container 10 is allowed to remain in the inverted position, as shown in FIG. 4 while the product solidifies. The product is now both effectively sealed within the container 10 to insure against solvent loss and shrinkage prior to use, and at the same time, is locked to the platform 30 to prevent its separation from the platform should the user attempt to withdraw the stick back into the container during use.

In the method of manufacturing the product employing the container 10a, the steps are identical to those set forth with respect to the structure of FIGS. 1 through 4 with the exception that the contoured sealing member 50 replaces the cap member 38 in providing a contour to the product. That is, while the product remains in the molten state, the sealing member 50 is applied to the top opening of the container 10a and the cover 48a is applied to the assembly prior to the container 10a being inverted in the process.

While the invention has been shown in but two forms of embodiment, it should be understood that various changes and modifications may be resorted to without departing from the spirit of the invention or the scope of the appended claims.

As my invention, I claim:

1. A process for the manufacture of a cosmetic product such as a deodorant in stick form which includes the steps of:

providing a tubular body having a top opening, a bottom wall through which a dial shaft extends, and a platform member movable within the tubular body by rotation of the dial shaft, said platform being provided with a plurality of openings formed therein of a size allowing the product in molten form to flow therethrough;

rotating said dial shaft to move said platform to a lowermost position in spaced relation with said bottom wall of said tubular body and introducing a predetermined quantity of product in molten form to flow through said top opening of said tubular body and said platform member openings to said bottom wall;

providing sealing means in the form of a contoured cap member inserted entirely within said tubular body;

inverting said tubular body while the product is in the molten condition causing the material to flow back through said platform member openings to said sealing means; and maintaining said tubular body in the inverted position during solidification of the product.

2. A process as set forth in claim 1 which includes the step of providing a sealing member covering said top opening of said tubular body after applying said contoured cap member.

3. A process as set forth in claim 1 wherein the product is composed of in the area of 75% of volatile material.

4. A process as set forth in claim 1 wherein said predetermined quantity of product is a measure of the volume from the interior surface of said bottom wall to a level adjacent said cap member.

5. A process as set forth in claim 4 wherein said sealing means comprises a contoured cap member having an internal surface of concave configuration and said predetermined quantity of product is of sufficient magnitude to fill the interior volume of said tubular body to adjacent the bottom surface of said platform with said tubular body in the inverted position.

6. A process as set forth in claim 5 which includes the step of providing a sealing member covering said top opening of said tubular body, after applying said cap member and prior to inverting said tubular body.

7. A process as set forth in claim 6 wherein the product is composed of in the area of 75% of a volatile material.

8. A process as set forth in claim 7 wherein the volatile material is ethyl alcohol.

9. A container for dispensing a cosmetic product such as a deodorant in stick form comprising:

a one piece body member formed of elongated tubular sidewalls open at the top end having a bottom wall section;

dial means in the form of a disc having a threaded shaft extending from one surface thereof, said shaft being disposed within said body member and extending through an opening formed in said bottom wall section;

a platform disposed within said body member having outer edges thereof substantially conforming to said tubular sidewalls, said platform having an opening formed at the center thereof for receiving said threaded shaft in threaded engagement therewith, and a unitary washer disposed between said one surface of said disc and the exterior surface of the said bottom wall; and a cap member inserted entirely within said tubular sidewalls of said body member, said opening formed in said bottom wall section being dimensioned to receive said shaft therein and said washer forming the entire seal between said one disc shaft and said opening found in said bottom wall section.

10. A container as set forth in claim 9 wherein said platform is provided with a plurality of openings formed therein of a size allowing the product in molten form to flow therethrough to said bottom wall of said body member.

11. A container as set forth in claim 9 wherein said cap member internal surface is of concave configuration to form the cosmetic product.

12. A container as set forth in claim 9 which further includes a sealing member covering said top opening of said tubular sidewalls.

13. A container as set forth in claim 9 wherein said washer is formed of a closed cell sponge material having skin surfaces contacting both said one disc surface and said bottom wall.

14. A container as set forth in claim 13 wherein said cap member internal surface is of concave configuration to form a shaped application surface on the top of a cosmetic product.

15. A container as set forth in claim 14 which further includes a sealing member covering said top opening of said tubular sidewalls.

16. A container as set forth in claim 15 wherein said washer is formed of a closed cell sponge material.

17. A container as set forth in claim 9 which further includes a contoured sealing member having an internal surface of concave configuration covering said top opening of said body member whereby said contoured sealing member is effective to both seal said top opening of said body member and provide a configuration to the top of a product contained in said body member.

18. A container as set forth in claim 17 further comprising a cover having a downwardly disposed opening formed by wall structure overlapping the outer surface of said tubular sidewalls, both the inner surface of said cover wall structure and the outer surface of said tubular sidewalls having a plurality of circumferential ribs formed thereon in spaced relation whereby said ribs disposed on said tubular sidewalls and said ribs disposed on said cover inner surface are in interfitting engagement with said cover disposed on said body member and said cover wall structure overlapping said tubular walls.

* * * * *